US010280817B2

(12) United States Patent
Maezako et al.

(10) Patent No.: US 10,280,817 B2
(45) Date of Patent: May 7, 2019

(54) VARIABLE VALVE MECHANISM OF INTERNAL COMBUSTION ENGINE

(71) Applicant: OTICS CORPORATION, Nishio-shi (JP)

(72) Inventors: Takayuki Maezako, Nishio (JP); Akira Sugiura, Nishio (JP)

(73) Assignee: OTICS CORPORATION, Nishio-Shi, Aichi-Ken (JP)

( * ) Notice: Subject to any disclaimer, the term of this patent is extended or adjusted under 35 U.S.C. 154(b) by 0 days.

(21) Appl. No.: 15/835,225

(22) Filed: Dec. 7, 2017

(65) Prior Publication Data

US 2018/0195421 A1 Jul. 12, 2018

(30) Foreign Application Priority Data

Jan. 10, 2017 (JP) ..... 2017-001739

(51) Int. Cl.
*F01L 1/18* (2006.01)
*F01L 13/00* (2006.01)

(52) U.S. Cl.
CPC ..... *F01L 13/0021* (2013.01); *F01L 1/18* (2013.01); *F01L 1/182* (2013.01); *F01L 1/185* (2013.01); *F01L 13/0005* (2013.01); *F01L 2001/186* (2013.01)

(58) Field of Classification Search
CPC ..... F01L 1/18; F01L 1/182; F01L 13/0005; F01L 13/0021; F01L 2001/186
USPC ..... 123/90.39, 90.44
See application file for complete search history.

(56) References Cited

U.S. PATENT DOCUMENTS 6,925,978 B1 8/2005 Gerzseny et al.
7,798,113 B2 * 9/2010 Fischer ..... F01L 1/185 123/90.39

FOREIGN PATENT DOCUMENTS

DE 102006057895 6/2008
WO WO 2008/138776 A1 11/2008

OTHER PUBLICATIONS

European Search Report, dated Jun. 11, 2018, in European Patent Application No. 17205841.4.

* cited by examiner

*Primary Examiner* — Ching Chang
(74) *Attorney, Agent, or Firm* — McGinn IP Law Group, PLLC.

(57) ABSTRACT

In a variable valve mechanism, during switching from a disconnected state to a connected state, the switch arm being displaced in a return direction comes in sliding contact with a pin end surface of the switch pin, and presses the pin end surface toward the disconnected position to push back the switch pin. At a sliding contact start time, the switch arm sliding contacts a portion of the pin end surface on a return direction side with respect to an idle-swing-side edge. At least during a period from a 10% position time to a sliding contact end time, a position of a pressed center relative to the pin end surface shifts toward the return direction side without stopping as the switch arm is displaced toward the return direction relative to a main arm, so that the sliding contact ends without stopping of the pressed center at a return-side edge.

14 Claims, 10 Drawing Sheets

VARIABLE VALVE MECHANISM OF INTERNAL COMBUSTION ENGINE

TECHNICAL FIELD

The present invention relates to a variable valve mechanism that drives a valve of an internal combustion engine and that changes the drive state of the valve according to the operational state of the internal combustion engine.

BACKGROUND ART

A variable valve mechanism 90 of a conventional example illustrated in FIGS. 7A and 7B includes a switch arm 91 driven by a cam, a main arm 92 that drives a valve of an internal combustion engine when swinging, and a switch pin 93 that is mounted on the main arm 92 so as to be displaceable. The switch pin 93 is displaced to a disconnected position C− so that the variable valve mechanism 90 is switched to a disconnected state as illustrated in FIG. 7A, and the switch pin 93 is displaced to a connected position C+ so that the variable valve mechanism 90 is switched to a connected state as illustrated in FIG. 7B.

As illustrated in FIG. 8A, during switching from the disconnected state to the connected state, if timing of the switching is inappropriate, the switch pin 93 protrudes to the connected position C+ while the switch arm 91 is swinging in an idle swing direction D1, so that the switch arm 91 comes below the switch pin 93. As a measure to prevent the switch arm 91 from being locked in such a case, a pressing surface 91*a* having a curved surface is formed at an end of the switch arm 91. With this configuration, as illustrated in FIGS. 9A to 9F, when the switch arm 91 swings in a return direction D2, the switch arm 91 presses a pin end surface 93*a* with the pressing surface 91*a* to the disconnected position C− so as to push back the switch pin 93.

CITATION LIST

Patent Document

Patent Document 1: U.S. Pat. No. 6,925,978

SUMMARY OF INVENTION

Technical Problem

In the conventional example, if the pressing surface 91*a* comes in contact with a lower edge E1 of the pin end surface 93*a* at a sliding contact start time T1 illustrated in FIG. 8B, an excessive bending load is applied to the switch pin 93. FIG. 3 of Patent Document 1 illustrates a state where the pressing surface 91*a* is in sliding contact with a portion of the pin end surface 93*a* above the lower edge E1, as illustrated in FIG. 9B. However, it is unclear whether this state represents a state at the sliding contact start time or represents a state at time T2 after the sliding contact start time and when the pressing surface 91*a* slightly presses the pin end surface 93*a* toward the disconnected position C−.

In addition, in the conventional example, the position of a pressed center P on the pin end surface 93*a* shifts upward as the switch arm 91 swings in the return direction D2 relative to the main arm 92 during the first-half of sliding contact from T1 to T4 illustrated in FIGS. 9A to 9D, but the pressed center P remains at an upper edge E2 during the second half of sliding contact from T4 to T6 illustrated in FIGS. 9D to 9F. Accordingly, as illustrated in FIG. 10C, the period in which the pressed center P is at the upper edge E2, that is, the period in which the pressing surface 91*a* is in sliding contact with the upper edge E2 is long, and thus, the upper edge E2 may easily wear. As illustrated in FIG. 10B, the upper edge E2 is a portion that first comes below the switch arm 91 when the variable valve mechanism 90 is switched to the connected state. Therefore, the wear may adversely affect a switching response.

Such a problem may also be caused by a phenomenon that the lower edge E1 of the pin end surface 93*a* wears due to contact of the pressing surface 91*a* with the lower edge E1 at the sliding contact start time T1 illustrated in FIG. 8B, and rotation of the switch pin 93 brings the lower edge E1 to the upper side.

It is an object of the present invention to make edges of a pin end surface difficult to wear.

Solution to Problem

To achieve the object described above, a variable valve mechanism of an internal combustion engine according to the present invention includes: a switch arm that is driven by a cam; a main arm that drives a valve of the internal combustion engine when swinging; a switch pin attached to the main arm so as to be displaceable; and a displacing device that displaces the switch pin to a disconnected position to switch the variable valve mechanism to a disconnected state where the switch arm makes a relative reciprocating displacement relative to the main arm in an idle swing direction and in a return direction opposite thereto according to rotation of the cam, and that displaces the switch pin to a connected position to switch the variable valve mechanism to a connected state where the switch arm and the main arm swing together. In the variable valve mechanism, during switching from the disconnected state to the connected state, if the switch pin is displaced to the connected position while the switch arm is displaced in the idle swing direction relative to the main arm and thus the switch arm comes to an idle swing direction side with respect to the switch pin, the switch arm being displaced in the return direction relative to the main arm comes in sliding contact with a pin end surface of the switch pin, and the switch arm presses the pin end surface toward the disconnected position during a period between a sliding contact start time (t1) and a sliding contact end time (t6) so as to push back the switch pin. The variable valve mechanism has at least one of the following features [A] and [B].

Hereinafter, a "pressed center" is defined as the center position of a pressing force received from the switch arm at a sliding contact portion of the pin end surface with the switch arm, and a "pin end surface length (Le)" is defined as the length along the pin end surface from an idle-swing-side edge of the pin end surface, which is an edge of the pin end surface on the idle swing direction side, to a return-side edge of the pin end surface, which is an edge of the pin end surface on a return direction side.

[A] In the variable valve mechanism, at the sliding contact start time (t1) when the switch pin is fully displaced to a connected position side, the switch arm does not sliding contact with an idle-swing-side edge, but sliding contacts a portion of the pin end surface on the return direction side with respect to the idle-swing-side edge.

[B] In the variable valve mechanism, at least during a period from a 10% position time (t5) at which a length (L5) from the pressed center to the return-side edge along the pin end surface is 10% of the pin end surface length (Le) to the sliding contact end time (t6), the position of the pressed center relative to the pin end surface shifts toward the return direction side without stopping as the switch arm is displaced toward the return direction relative to the main arm, so that the sliding contact ends without stopping of the pressed center at the return-side edge.

Advantageous Effects of Invention

According to the feature [A] described above, since the switch arm does not sliding contact with the idle-swing-side edge at the sliding contact start time (t1), the idle-swings-side edge does not wear, and the switch pin is difficult to be subjected to an excessive bending load.

According to the feature [B] described above, since the pressed center does not stop at the return-side edge, the return-side edge is difficult to wear.

DESCRIPTION OF EMBODIMENTS

Figure 1B:
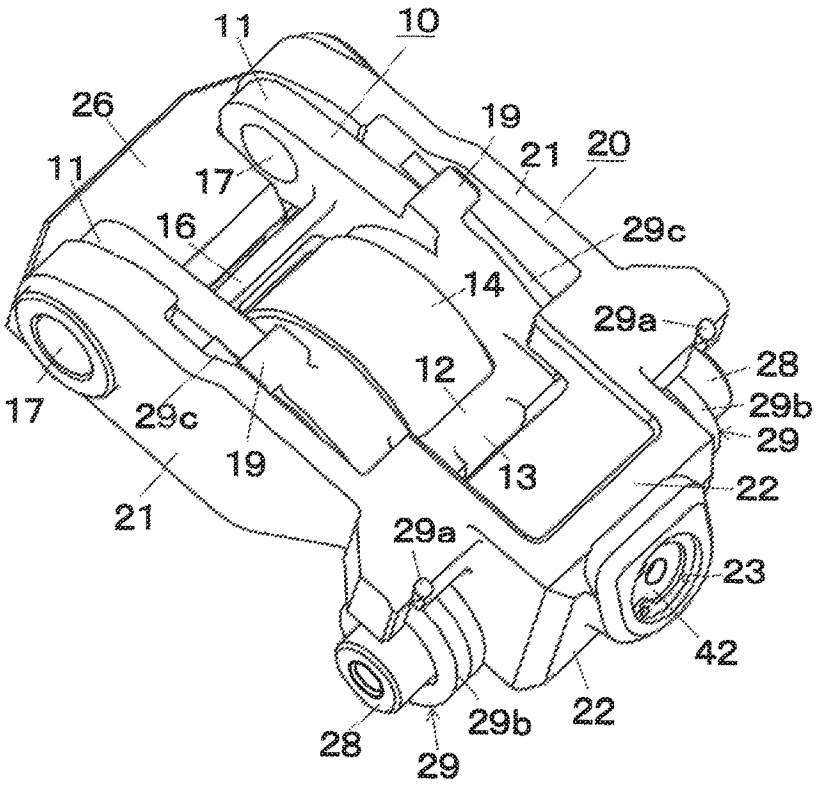
FIG. 1B is a perspective view illustrating a switch arm and a main arm of the variable valve mechanism of the embodiment.

In the feature [A] described above, although a length (L1) along the pin end surface from the idle-swing-side edge to the pressed center at the sliding contact start time (t1) is not particularly limited, the length (L1) is preferably equal to or greater than 10%, more preferably equal to or greater than 15%, and still more preferably equal to or greater than 20% of the pin end surface length (Le), from the viewpoint that a portion of the pin end surface on the inner side with respect to the idle-swing-side edge is made difficult to wear over a wider range.

Although the upper limit of the length (L1) is not particularly limited, the length (L1) is preferably equal to or smaller than 90%, more preferably equal to or smaller than 85%, and still more preferably equal to or smaller than 80% of the pin end surface length (Le), from the viewpoint that a portion of the pin end surface on the inner side with respect to the return-side edge is made difficult to wear over a wider range.

In the feature [B] described above, if the relative reciprocating displacement is a relative swing, although an angle (θ) by which the switch arm swings relative to the main arm in the return direction from the 10% position time (t5) to the sliding contact end time (t6) is not particularly limited, the angle (θ) is preferably equal to or smaller than 8 degrees, more preferably equal to or smaller than 6 degrees, and still more preferably equal to or smaller than 4 degrees, from the viewpoint that the pressed center quickly passes through the return-side edge and the vicinity thereof.

Although the lower limit value of the angle (θ) is not particularly limited, the angle (θ) is preferably equal to or greater than 0.3 degrees, more preferably equal to or greater than 0.6 degrees, and still more preferably equal to or greater than 1.0 degree, from the viewpoint of ease of implementation.

In the feature [B] described above, the variable valve mechanism is preferably configured such that, although a time before the 10% position time (t5) is not particularly limited, the position of the pressed center relative to the pin end surface shifts toward the return direction side without stopping as the switch arm is displaced in the return direction relative to the main arm from a return side shift start time (t3) to the sliding contact end time (t6), from the viewpoint that the portion of the pin end surface on the inner side with respect to the return-side edge is made difficult to wear over a wider range. The return side shift start time (t3) is a time when a length (L3) along the pin end surface from the pressed center to the return-side edge is equal to or greater than 20% (more preferably equal to or greater than 30%, and still more preferably equal to or greater than 40%) of the pin end surface length (Le).

Although the upper limit of the length (L3) along the pin end surface from the pressed center to the return-side edge at the return-side shift start time (t3) is not particularly limited, the length (L3) is preferably equal to or smaller than 95%, more preferably equal to or smaller than 90%, and still more preferably equal to or smaller than 85% of the pin end surface length (Le), from the viewpoint that the portion of the pin end surface on the inner side with respect to the idle-swing-side edge is made difficult to wear over a wider range.

Although the return-side shift start time (t3) may be the same as the sliding contact start time (t1), the return side shift start time (t3) is preferably later than the sliding contact start time (t1), from the viewpoint that an increase in speed of the shift in the return direction during the second half of sliding contact causes the pressed center to more quickly pass through the return-side edge and the vicinity thereof. Furthermore, the variable valve mechanism is preferably configured such that a predetermined portion of the switch arm comes in sliding contact with the pin end surface at the sliding contact start time (t1), a portion of the switch arm on the idle swing direction side with respect to the predetermined portion comes in sliding contact with the pin end surface at the return side shift start time (t3), so that the position of the pressed center relative to the pin end surface shifts toward the idle swing direction side during a period from the sliding contact start time (t1) to the return side shift start time (t3).

In the case where the variable valve mechanism has the feature [A] or [B] described above, although the aspect of the switch arm is not particularly limited, the following aspects thereof are exemplified. The aspect [1] is preferable from the viewpoint of ease of implementation.

[1] The switch arm is pivotally attached in a relatively swingable manner to the main arm, and the relative reciprocating displacement is a relative swing.

[2] The switch arm is attached to the main arm so as to be relatively displaceable in a linear direction, and the relative reciprocating displacement is a relative reciprocating linear movement.

Although the switch pin may be displaced in the width direction of the main arm, the main arm preferably includes two main arm sidewall portions provided on both sides of the switch arm in the width direction and a connecting portion for connecting the two main arm sidewall portions to each other, and the switch pin is preferably attached to the connecting portion so as to be displaceable in the longitudinal direction of the main arm, from the viewpoint that the switch arm can easily push back the switch pin.

The displacing device may hydraulically displace the switch pin to the connected position. However, from the viewpoint that switch arm can easily push back the switch pin, the displacing device preferably includes: a spring for urging the switch pin toward the connected position; and a hydraulic device that hydraulically presses the switch pin toward the disconnected position, and the hydraulic device is preferably configured to hydraulically displace the switch pin to the disconnected position by relatively increasing the hydraulic pressure and displace the switch pin to the connected position with an urging force of the spring by relatively reducing the hydraulic pressure.

Although the disconnected state and the connected state are not particularly limited, the following aspects thereof are exemplified.

[1] The disconnected state is a stop state where driving of the valve is stopped. The connected state is a drive state where the valve is driven.

[2] The disconnected state is a low lift state where the main arm is driven by a second cam to drive the valve at a relatively small lift amount. The connected state is a high lift state where the valve is driven at a relatively large lift amount.

EMBODIMENT

The following describes an embodiment of the present invention. The present invention is not limited to the embodiment, and can be carried out by modifying configurations and/or shapes of various parts in any manner without departing from the scope of the present invention.

Figure 1A:
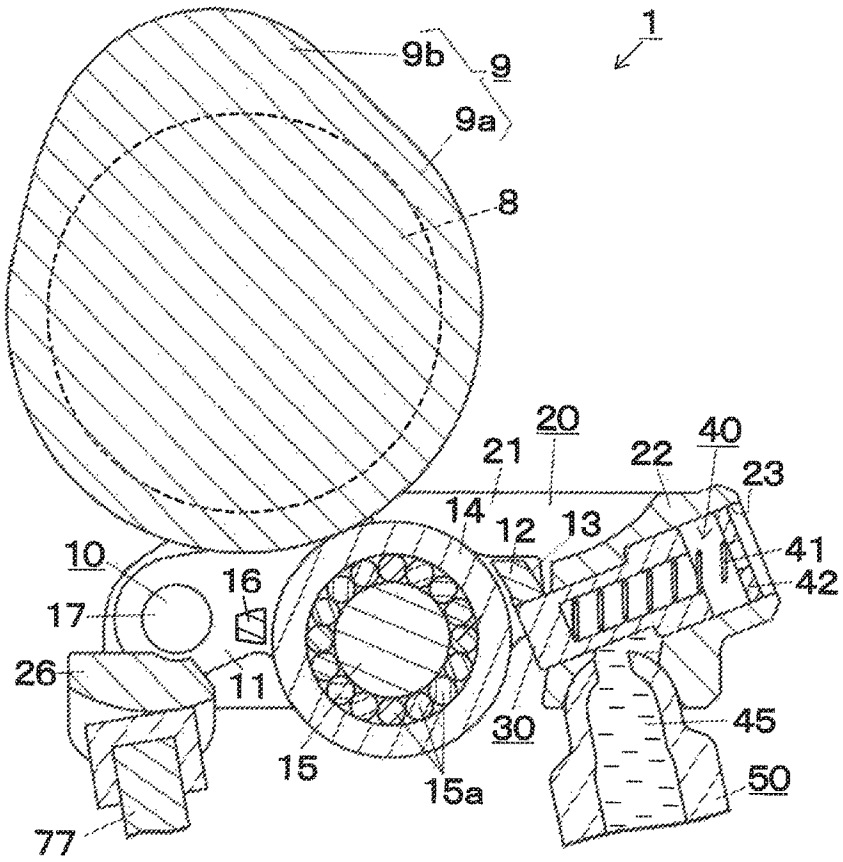
FIG. 1A is a side view illustrating a variable valve mechanism of an embodiment of the present invention.

As illustrated in FIG. 1A, a variable valve mechanism 1 of the present embodiment is attached to a valve 77 of an internal combustion engine. The valve 77 may be an intake valve or an exhaust valve. A valve spring (not illustrated) that urges the valve 77 in such a direction that the valve 77 is closed is attached to the valve 77. The variable valve mechanism 1 periodically presses the valve 77 to open and close the valve 77 in cooperation with the valve spring. The variable valve mechanism 1 includes a cam 9, a switch arm 10, a main arm 20, a switch pin 30, a displacing device 40, and a pivot 50.

The cam 9 is mounted on a camshaft 8 so as to protrude therefrom. The camshaft 8 turns once (a 360-degree turn) every two turns of the internal combustion engine (a 720-degree turn). The cam 9 has a base circle 9*a* having a circular sectional shape and a nose 9*b* projecting from the base circle 9*a*.

The switch arm 10 includes two switch arm sidewall portions 11, a switch arm rear portion 12, a bridge portion 16, a roller shaft 15 and a roller 14. The two switch arm sidewall portions 11 are arranged side by side across a space in the width direction. A front end portion of each of the switch arm sidewall portions 11 is pivotally attached in a swingable manner to a front portion of a main arm sidewall portion 21 by a shaft member 17.

The switch arm rear portion 12 connects rear end portions of the two switch arm sidewall portions 11 to each other. A pressing surface 13 that presses a pin end surface 36 of the switch pin 30 is formed on a rear surface of the switch arm rear portion 12. The pressing surface 13 has a shape (tapered shape) such that the pressing surface 13 extends away from the shaft member 17 (center of swinging in the disconnected state) as it extends toward an idle swing direction D1 side, and the pressing surface 13 extends toward the shaft member 17 as it extends toward a return direction D2 side. The bridge portion 16 connects front portions of the switch arm sidewall portions 11 to each other.

The roller 14 is rotatably attached between the two switch arm sidewall portions 11 and between the switch arm rear portion 12 and the bridge portion 16 via the roller shaft 15. The roller shaft 15 penetrates the two switch arm sidewall portions 11 in the width direction. A bearing 15*a* is interposed between the roller 14 and the roller shaft 15. The cam 9 presses the roller 14 to drive the switch arm 10.

The main arm 20 includes two main arm sidewall portions 21, a main arm rear portion 22, and a main arm front portion 26. The two main arm sidewall portions 21 are provided on both sides of the switch arm 10 in the width direction. The main arm front portion 26 connects front ends of the two main arm sidewall portions 21 to each other. The main arm front portion 26 is in contact with a stem end of the valve 77. The main arm rear portion 22 connects rear end portions of the two main arm sidewall portions 21 to each other.

Projections 28 projecting outward in the width direction are provided on both side surfaces of the main arm rear portion 22, and a coil portion 29*b* of a lost motion spring 29 is externally fitted to each of the projections 28. Each lost motion spring 29 includes the coil portion 29*b* and a first side portion 29*a* and a second side portion 29*c* extending from the coil portion 29*b*. The first side portion 29*a* abuts on the rear end portion of a corresponding one of the main arm sidewall portions 21, and the second side portion 29*c* abuts on a projection 19 provided at an upper portion of a corresponding one of the switch arm sidewall portions 11.

The lost motion spring 29 is a spring that causes the switch arm 10 to follow the cam 9 in the disconnected state.

Figure 2B:
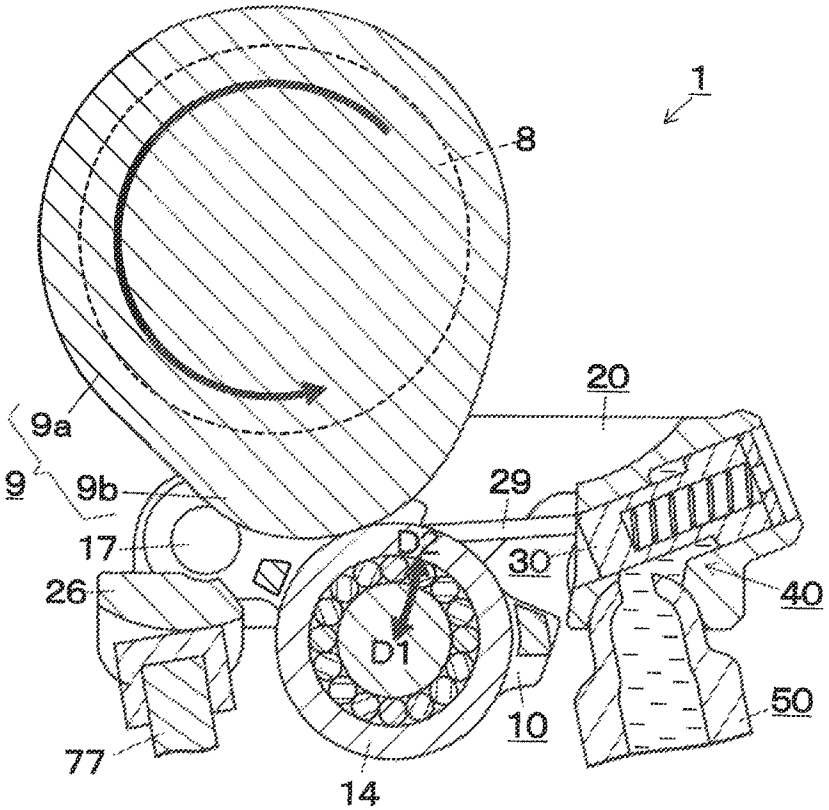
FIG. 2B is a side view illustrating the variable valve mechanism of the embodiment in the disconnected state.
Figure 2A:
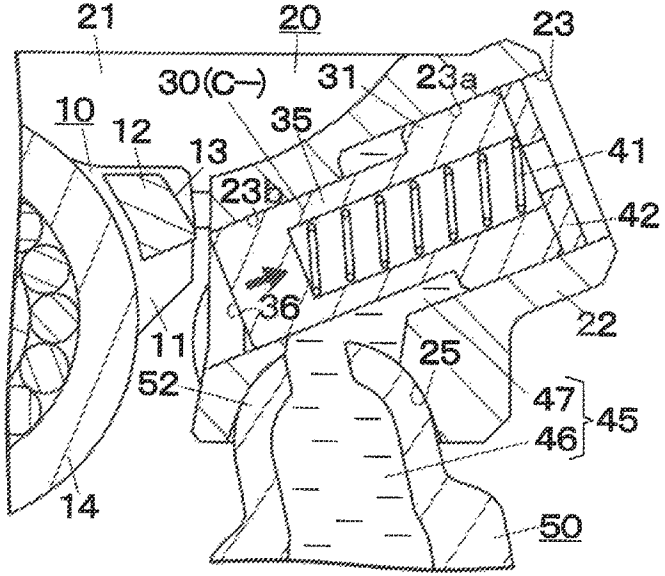
FIG. 2A is a side view illustrating a state when the variable valve mechanism of the embodiment is switched to a disconnected state.

As illustrated in FIG. 2A, a hemispherical concave portion 25, which is a recess formed in a lower surface of the main arm rear portion 22, is placed on a hemispherical portion 52 located at an upper end portion of the pivot 50, so that the main arm 20 is swingably supported by the pivot 50. The pivot 50 may be a lash adjuster that automatically eliminates a valve clearance, or may be an ordinary pivot not having such a function.

The switch pin 30 is inserted in a pin hole 23 that is provided in the main arm rear portion 22 so as to extend in the longitudinal direction of the main arm 20, and thus the switch pin 30 is attached to the main arm rear portion 22 so as to be displaceable in the longitudinal direction of the main arm 20. The switch pin 30 includes a pin large-diameter portion 31 on the rear side thereof and a pin small-diameter portion 35 on the front side thereof . The pin small-diameter portion 35 has a diameter smaller than that of the pin large-diameter portion 31. The pin hole 23 has a pin hole large-diameter portion 23*a* on the rear side thereof and a pin hole small-diameter portion 23*b* on the front side thereof. The diameter of the pin hole large-diameter portion 23*a* is substantially equal to the outside diameter of the pin large-diameter portion 31. The diameter of the pin hole small-diameter portion 23*b* is substantially equal to the outside diameter of the pin small-diameter portion 35.

The switch pin 30 is displaced rearward along the pin hole 23, so that the switch pin 30 is displaceable to a disconnected position C−. The disconnected position C− is a position in which the pin small-diameter portion 35 no longer extends across the main arm rear portion 22 and the switch arm rear portion 12 as the front portion of the pin small-diameter portion 35 recedes into the pin hole 23.

The displacing device 40 includes a spring 41 and hydraulic device 45. The spring 41 is interposed between a retainer 42 attached to the pin hole large-diameter portion 23*a* and the switch pin 30, and urges the switch pin 30 toward a connected position C+ (forward). The hydraulic device 45 includes an oil passage 46 and a hydraulic chamber 47. The oil passage 46 is a passage through which hydraulic pressure is supplied to the hydraulic chamber 47. The oil passage 46 extends to the hydraulic chamber 47 through the inside of a cylinder head, the inside of the pivot 50, and the inside of the main arm rear portion 22. The hydraulic chamber 47 is formed by filling a space in the pin hole large-diameter portion 23*a* formed on the front side of the pin large-diameter portion 31 with oil. The hydraulic pressure in the hydraulic chamber 47 presses the pin large-diameter portion 31 toward the disconnected position C− (rearward). The hydraulic device 45 relatively increases the hydraulic pressure (turns on the hydraulic pressure) in the hydraulic chamber 47 so as to displace the switch pin 30 to the disconnected position C− against the urging force of the spring 41. The variable valve mechanism 1 is thus switched to the disconnected state.

As illustrated in FIG. 2B, the disconnected state is a state where the switch arm 10 swings about the shaft member 17 in the idle swing direction D1 and the return direction D2 opposite thereto according to the rotation of the cam 9. At this time, the main arm 20 does not swing, but is stationary. Accordingly, disconnected state is a stop state where driving of the valve 77 is stopped.

Figure 3B:
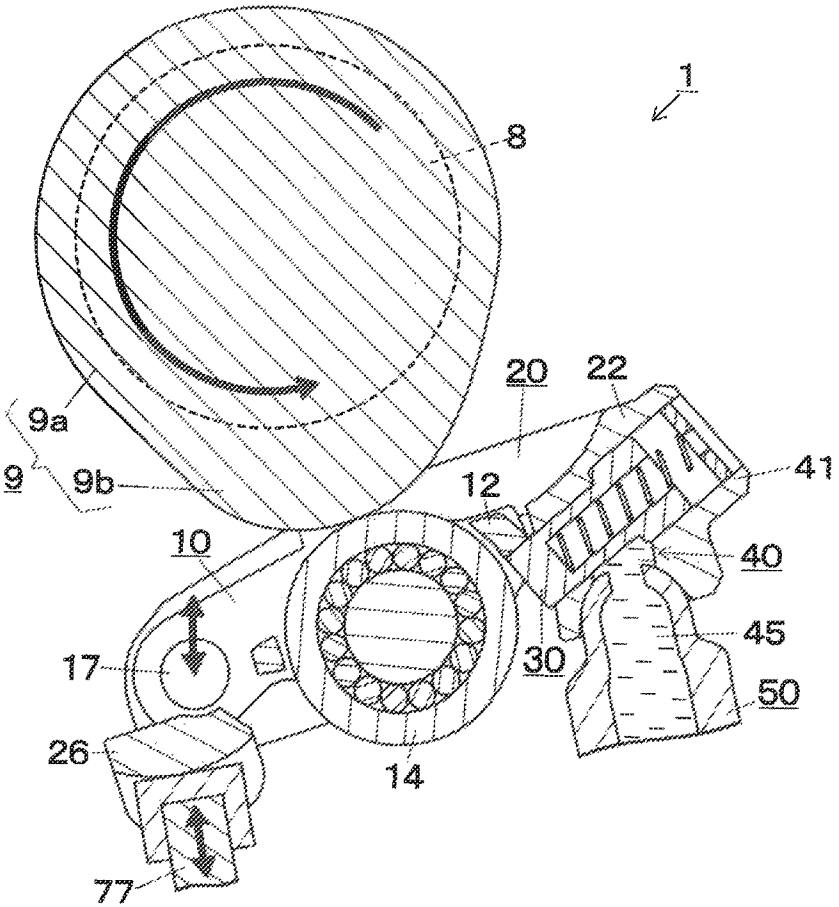
FIG. 3B is a side view illustrating the variable valve mechanism of the embodiment in the connected state.
Figure 3A:
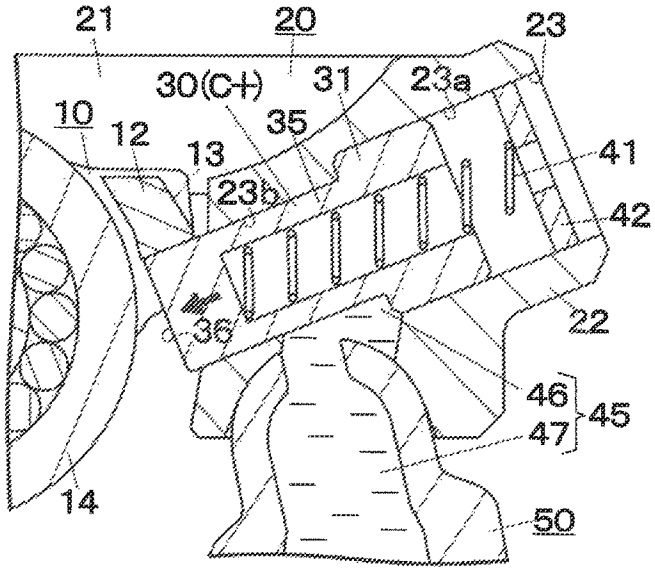
FIG. 3A is a side view illustrating a state when the variable valve mechanism of the embodiment is switched to a connected state.

As illustrated in FIG. 3A, the switch pin 30 is displaced forward along the pin hole 23, so that the switch pin 30 is displaceable to the connected position C+. The connected position C+ is a position in which the pin small-diameter portion 35 extends across the main arm rear portion 22 and the switch arm rear portion 12 as the front portion of the pin small-diameter portion 35 projects beneath the switch arm rear portion 12 from the pin hole 23. In the state where the switch pin 30 is fully disposed in the connected position C+ side (front side), the end surface of the pin large-diameter portion 31 adjacent the pin small-diameter portion 35 (front side) abuts on the end surface of the pin hole large-diameter portion 23*a* adjacent the pin hole small-diameter portion 23*b* (front side).

The hydraulic device 45 relatively reduces the hydraulic pressure (turns off the hydraulic pressure) in the hydraulic chamber 47 so as to displace the switch pin 30 to the connected position C+ with the urging force of the spring 41. Accordingly, the variable valve mechanism 1 is switched to the connected state.

As illustrated in FIG. 3B, the connected state is a state where the switch arm 10 and the main arm 20 swing together according to the rotation of the cam 9. At this time, the main arm 20 presses the valve 77 with the main arm front portion 26. Thus the valve 77 is driven and brought in to a drive state.

Figure 4A:
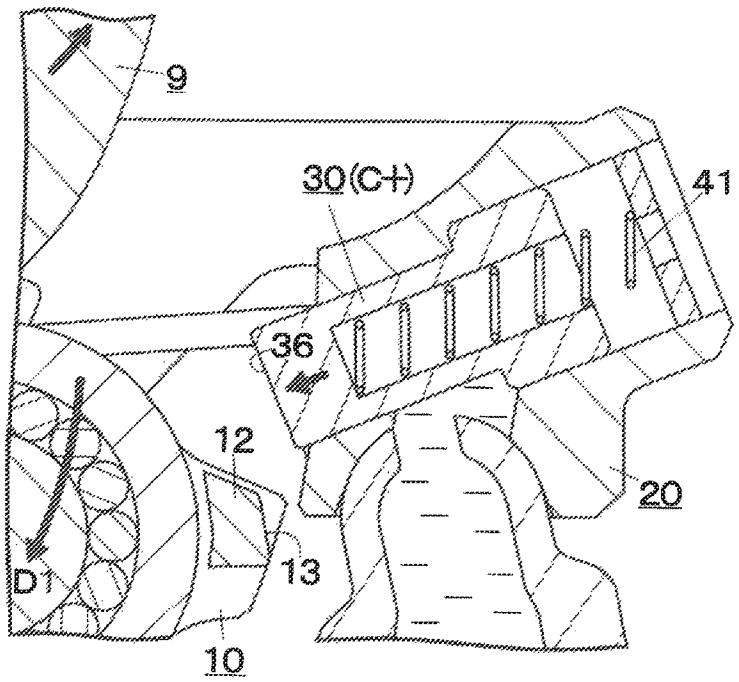
FIG. 4A is a side view illustrating a state where the switch arm of the variable valve mechanism of the embodiment has come below a switch pin.
Figure 4B:
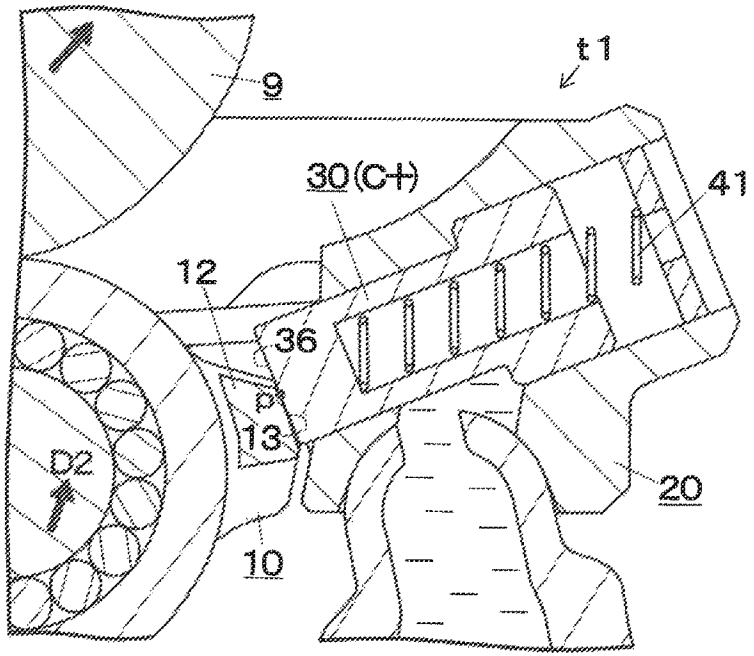
FIG. 4B is a side view illustrating a state at the start of sliding contact, in the variable valve mechanism of the embodiment.

As illustrated in FIG. 4A, during the switching from the disconnected state to the connected state, if timing of the switching is inappropriate, the switch pin 30 is displaced to the connected position C+ while the switch arm 10 is swinging in the idle swing direction D1, and thus the switch arm 10 comes to the idle swing direction D1 side with respect to the switch pin 30. In that case, the pressing surface 13 of the switch arm 10 being displaced toward the return direction D2 comes in sliding contact with the pin end surface 36 of the switch pin 30 as illustrated in FIG. 4B, and the pressing surface 13 presses the pin end surface 36 toward the disconnected position C− during a period between a sliding contact start time t1 and a sliding contact end time t6 as illustrated in FIGS. 5A to 5F. The switch pin 30 is thus pushed back.

Hereinafter, an edge of the pin end surface 36 on the idle swing direction D1 side is referred to as an "idle-swing-side edge E1"; an edge of the pin end surface 36 on the return direction D2 side is referred to as a "return-side edge E2"; the center position of a pressing force applied to the pin end surface 36 in a sliding contact portion of the pressing surface 13 with the pin end surface 36 is referred to as a "pressing center p"; and the center position of the pressing force received from the pressing surface 13 in a sliding contact portion of the pin end surface 36 with the pressing surface 13 is referred to as a "pressed center p". The same symbol "p" is assigned in this manner because the pressing center p of the pressing surface 13 and the pressed center p of the pin end surface 36 abut on and coincide with each other.

Figures 5A, 5B, 5C, 5D, 5E, 5F:
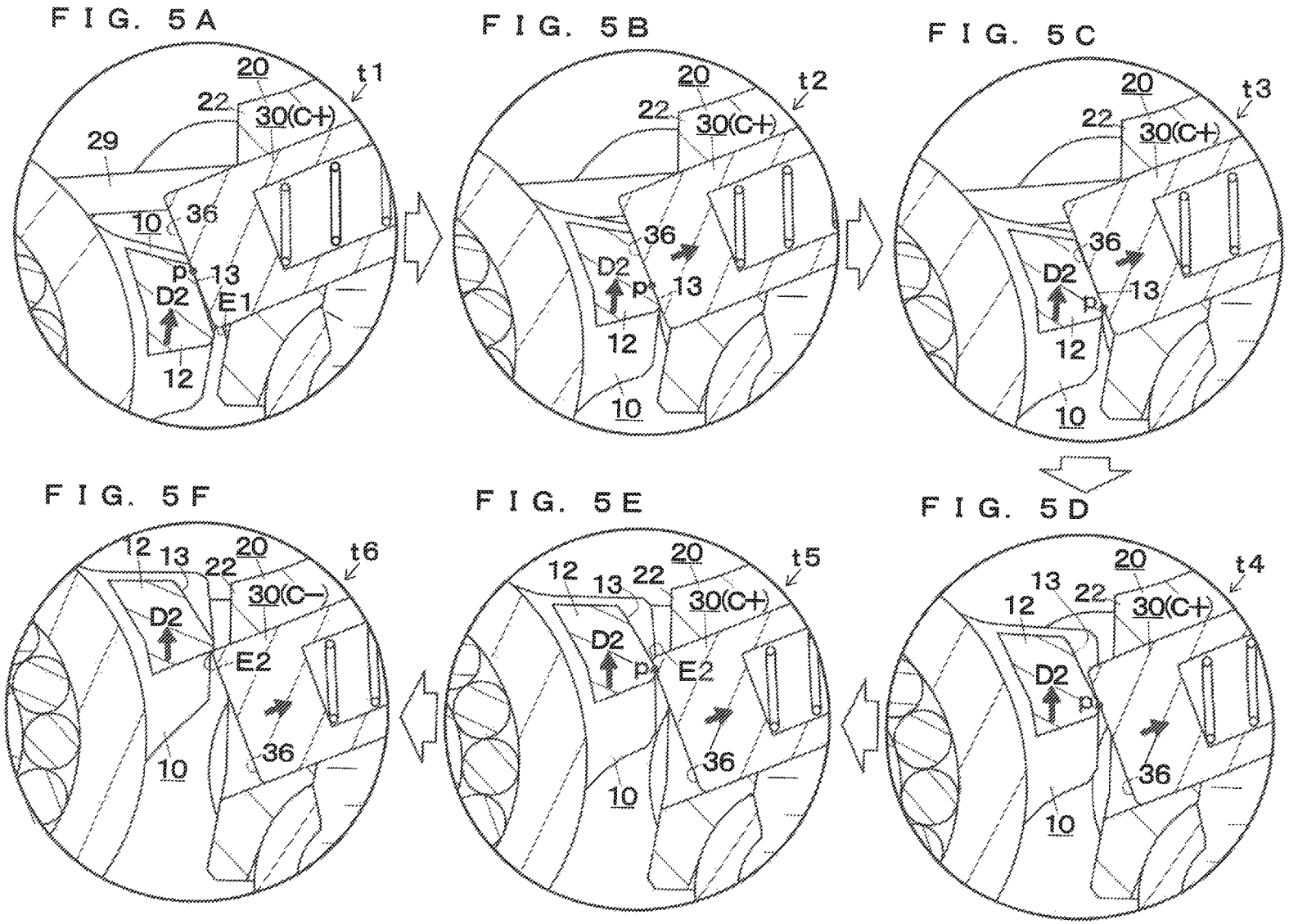
FIGS. 5A to 5F are side views sequentially illustrating states from the start of sliding contact to the end of sliding contact in the variable valve mechanism of the embodiment.

At the sliding contact start time t1 illustrated in FIG. 5A, the switch pin 30 is fully displaced to the connected position C+ side. The pressing surface 13 is not in sliding contact with the idle-swing-side edge E1, but a portion of the pressing surface 13 on the return direction D2 side is in sliding contact with a portion of the pin end surface 36 that is on the return direction D2 side with respect to the idle-swing-side edge E1.

During a period from the sliding contact start time t1 through a first-half intermediate time t2 illustrated in FIG. 5B to a return side shift start time t3 illustrated in FIG. 5C, the position of the pressing center p on the pressing surface 13 shifts toward the idle swing direction D1 side as the switch arm 10 swings in the return direction D2. Accordingly, the position of the pressed center p on the pin end surface 36 also shifts toward the idle swing direction D1 side.

Figure 6B:
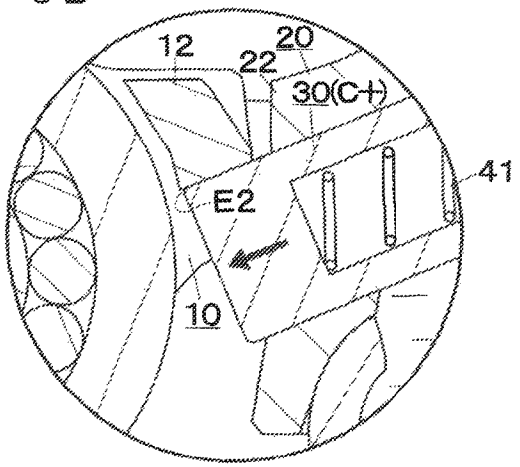
FIG. 6B is a side view illustrating a state thereafter.
Figure 6A:
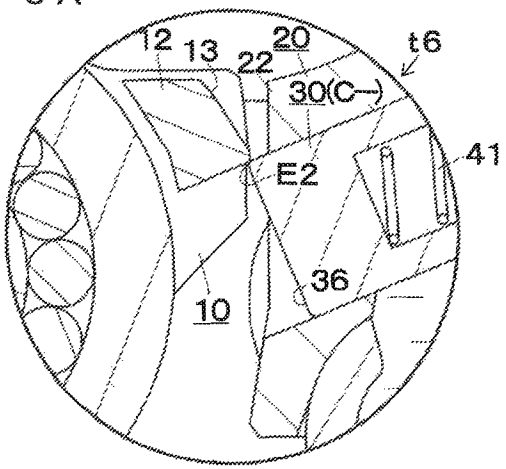
FIG. 6A is a side view illustrating the state at the end of sliding contact.

At the return side shift start time t3, a portion of the pressing surface 13 on the idle swing direction D1 side is in sliding contact with the pin end surface 36. During a period from the return side shift start time t3 through a second-half intermediate time t4 illustrated in FIG. 5D and a 10% position time t5 illustrated in FIG. 5E to the sliding contact end time t6 illustrated in FIG. 5F, the portion of the pressing surface 13 on the idle swing direction D1 side sliding contacts with the pin end surface 36. During this period from the return side shift start time t3 to the sliding contact end time t6, the position of the pressed center p on the pin end surface 36 shifts toward the return direction D2 side without stopping as the switch arm 10 swings in the return direction D2. At the sliding contact end time t6, the pressed center p does not stop at the return side edge E2 and the sliding contact ends. At the sliding contact end time t6, the switch pin 30 is pushed back to the disconnected position C−. After the sliding contact end time t6, the switch pin 30 is displaced again to the connected position C+ by the urging force of the spring 41, as illustrated in FIG. 6B.

Figure 6C:
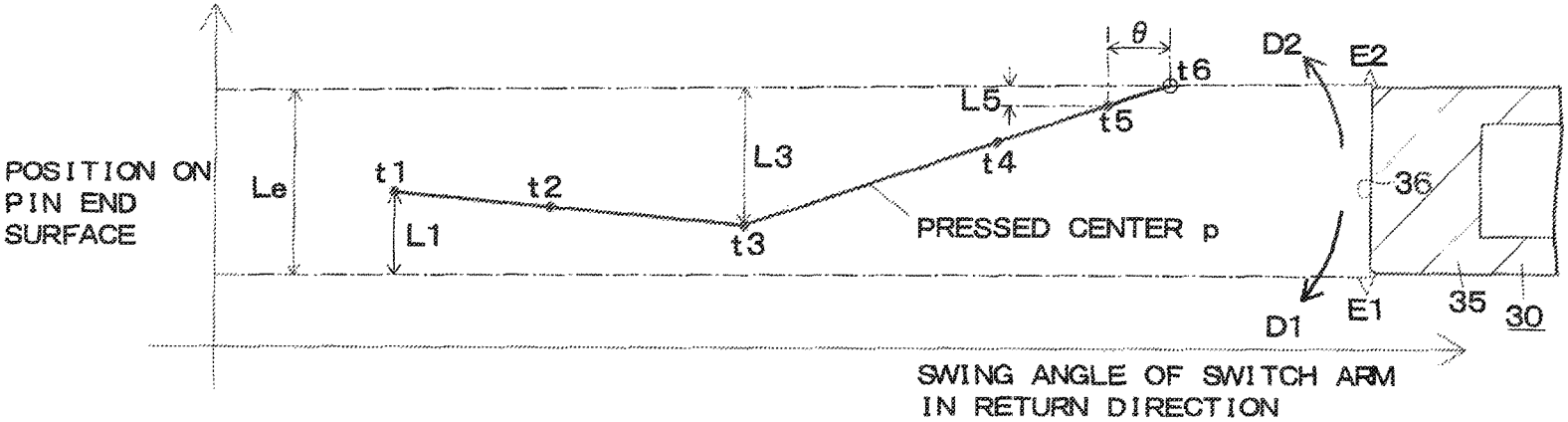
FIG. 6C is a graph illustrating how the position of a pressed center on a pin end surface shifts as the switch arm swings, in the variable valve mechanism of the embodiment.
Figure 7B:
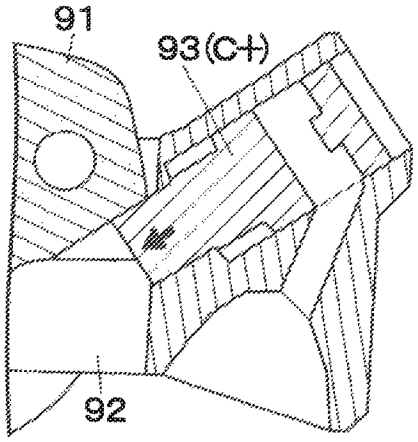
FIG. 7B PRIOR ART
FIG. 7B is a side view illustrating the variable valve mechanism of the conventional example in the connected state.
Figure 7A:
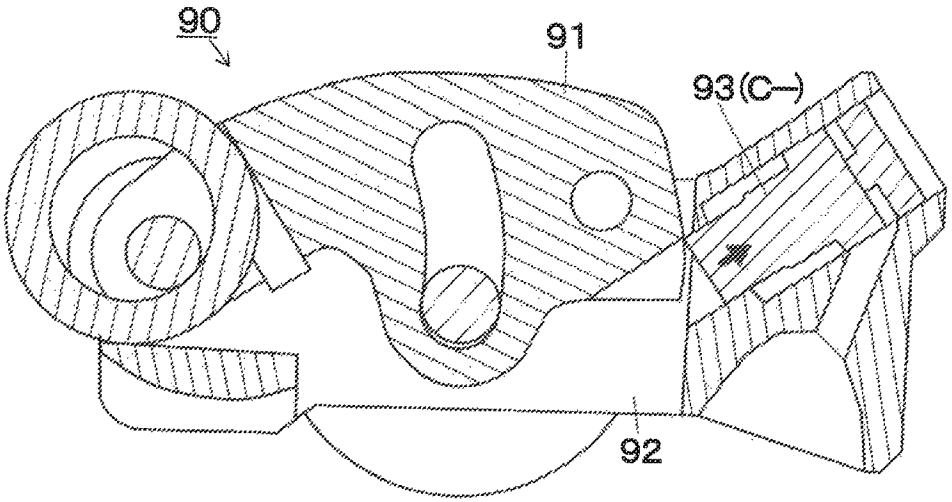
FIG. 7A PRIOR ART
FIG. 7A is a side view illustrating a variable valve mechanism of a conventional example in the disconnected state.
Figure 8B:
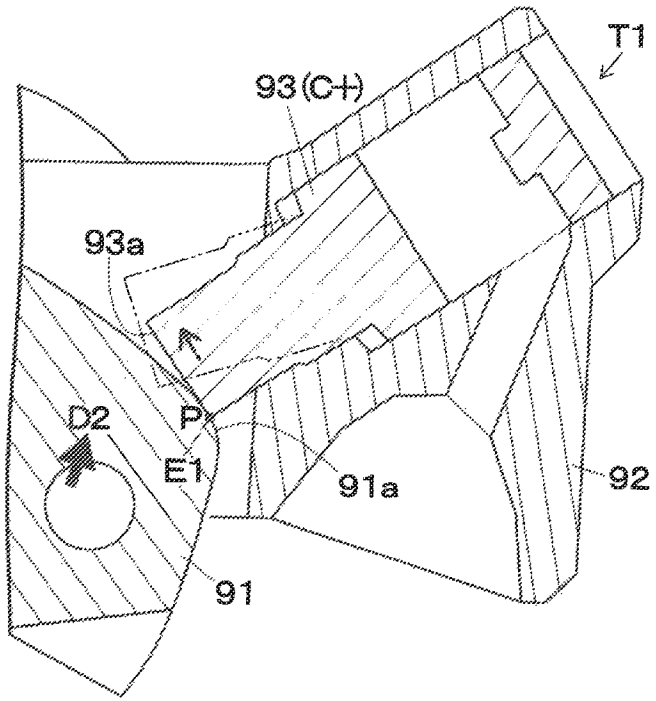
FIG. 8B PRIOR ART
FIG. 8B is a side view illustrating a state at the start of sliding contact, in the variable valve mechanism of the conventional example.
Figure 8A:
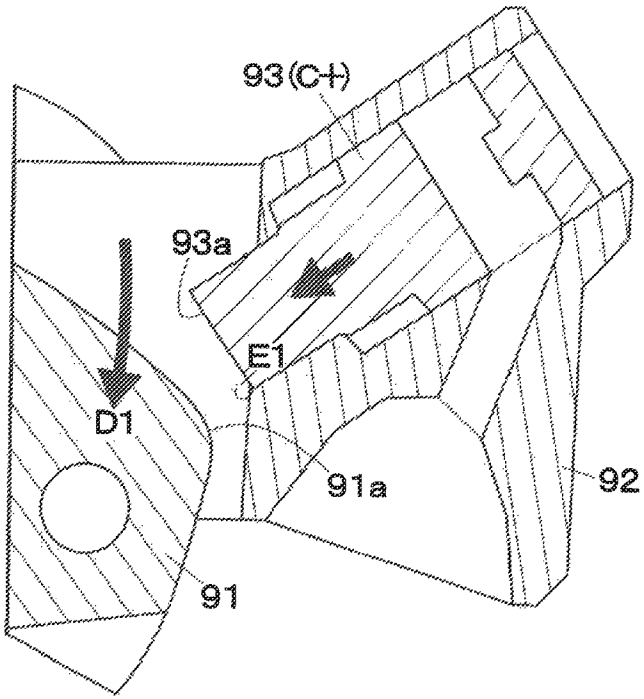
FIG. 8A PRIOR ART
FIG. 8A is a side view illustrating a state where a switch arm of the variable valve mechanism of the conventional example has come below a switch pin.
Figure 9A:
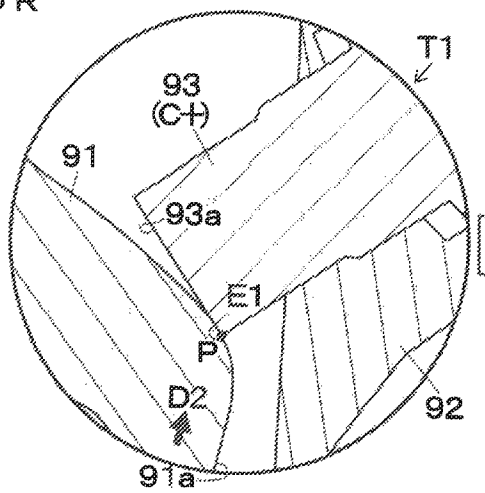
PRIOR ART FIG. 9A
FIGS. 9A to 9F are side views sequentially illustrating states from the start of sliding contact to the end of sliding contact in the variable valve mechanism of the conventional example.
Figure 9B:
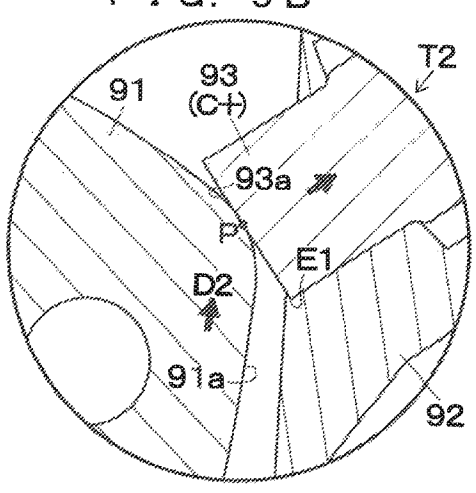
Figure 9C:
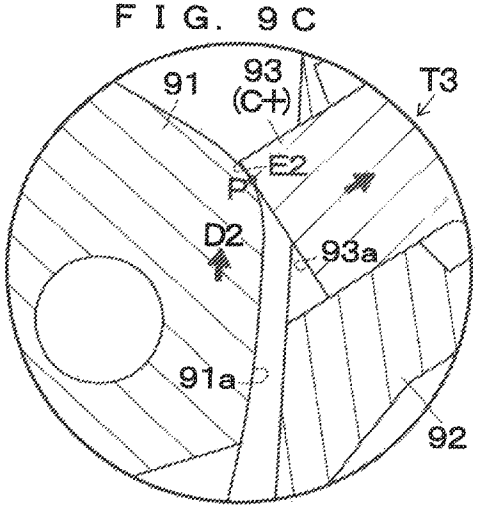
Figure 9D:
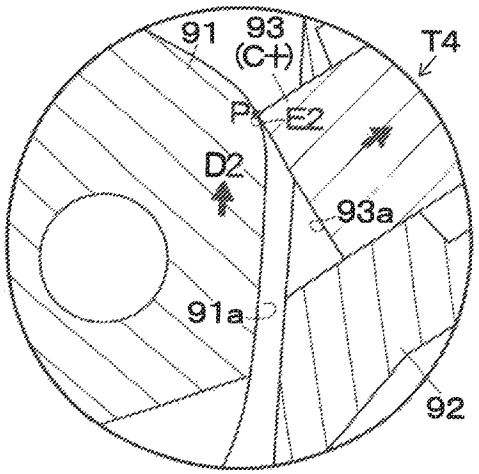
Figure 9E:
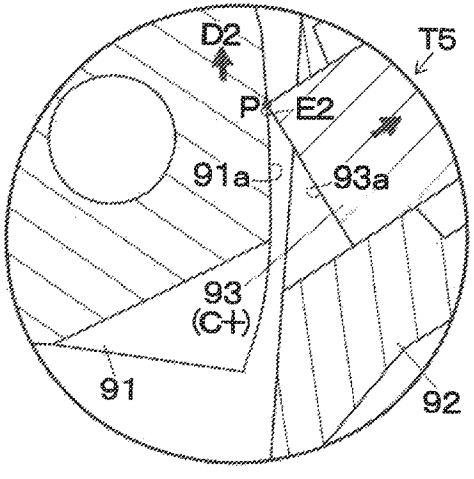
Figure 9F:
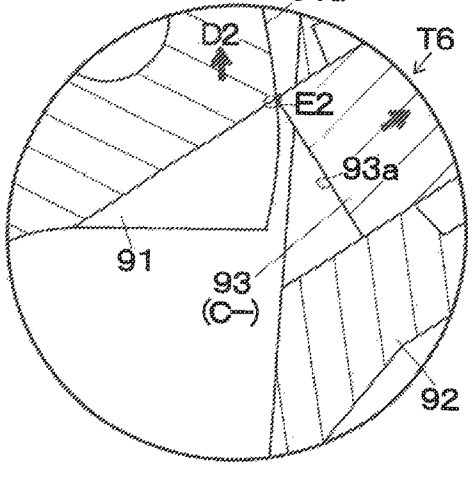

FIG. 6C illustrates how the position of the pressed center p on the pin end surface 36 shifts as the switch arm 10 swings in the return direction D2. Hereinafter, the length from the idle-swing-side edge E1 to the return-side edge E2 along the pin end surface 36 is referred to as a "pin end surface length Le". Since portions of the pin end surface 36 in the vicinity of the edges E1 and E2 are chamfered to be rounded, the pin end surface length Le is slightly longer than the linear distance from the idle-swing-side edge E1 to the return-side edge E2 (diameter of the pin small-diameter portion 35).

A length L1 from the idle-swing-side edge E1 to the pressed center p at the sliding contact start time t1 along the pin end surface 36 is substantially 45% to 55% of the pin end surface length Le. A length L3 from the pressed center p at the return side shift start time t3 to the return-side edge E2 along the pin end surface 36 is substantially 70% to 80% of the pin end surface length Le.

Figure 10B:
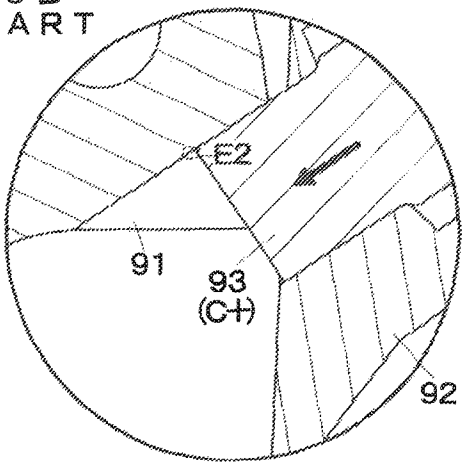
FIG. 10B PRIOR ART
FIG. 10B is a side view illustrating a state thereafter.
Figure 10A:
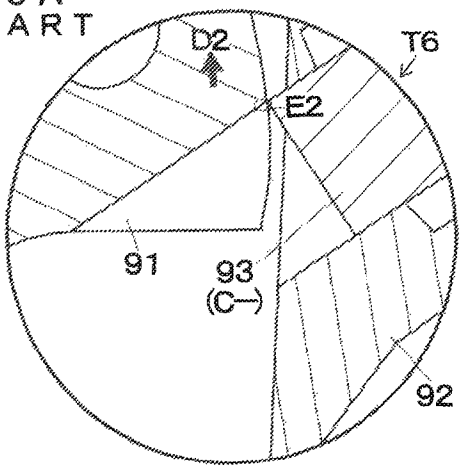
FIG. 10A PRIOR ART
FIG. 10A is a side view illustrating the state at the end of the sliding contact.
Figure 10C:
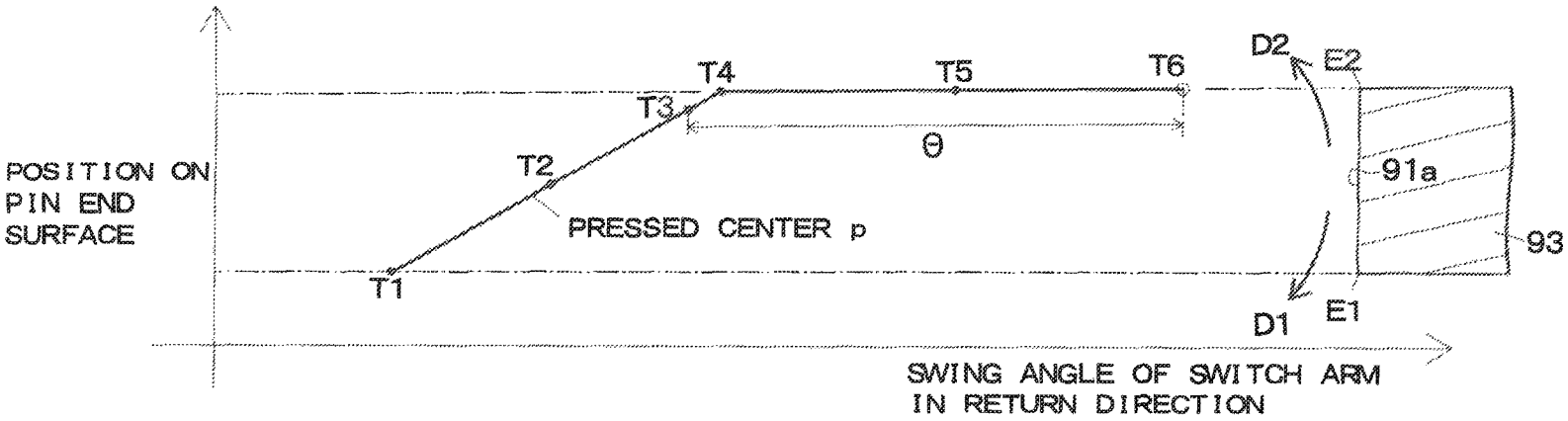
FIG. 10C PRIOR ART
FIG. 10C is a graph illustrating how the position of a pressed center on a pin end surface shifts as the switch arm swings, in the variable valve mechanism of the conventional example.

The 10% position time t5 is a time when a length L5 from the pressed center p to the return-side edge E2 along the pin end surface 36 is 10% of the pin end surface length Le. The angle θ by which the switch arm 10 swings in the return direction D2 during a period from the 10% position time t5 to the sliding contact end time t6 is substantially 1.5 degrees to 2.5 degrees. The angle θ is much smaller than a corresponding angle Θ of a conventional example illustrated in FIG. 10C.

According to the present embodiment, the following effects can be obtained.

[A] Since the pressing surface 13 does not contact the idle-swing-side edge E1 at the sliding contact start time t1, the switch pin 30 is difficult to be subjected to an excessive bending load.

[B] Since the pressing surface 13 does not sliding contact with the idle-swing-side edge E1 at the sliding contact start time t1, the idle-swing-side edge E1 does not wear. Since the pressed center p merely passes through the return-side edge E2 immediately before the sliding contact end time t6 and does not stop at the return-side edge E2, the return-side edge E2 is difficult to wear. This allows minimizing adverse effects on switching response that result from wear of edges of the pin end surface 36.

REFERENCE SIGNS LIST

1 variable valve mechanism
9 cam
10 switch arm
20 main arm
21 main arm sidewall portion
22 main arm rear portion (connecting portion)
30 switch pin
36 pin end surface
40 displacing device
41 spring
45 hydraulic device
77 valve
D1 idle swing direction
D2 return direction
E1 idle-swing-side edge
E2 return-side edge
C− disconnected position
C+ connected position
p pressed center
t1 sliding contact start time
t3 return side shift start time
t5 10% position time
t6 sliding contact end time

The invention claimed is:

1. A variable valve mechanism of an internal combustion engine, comprising:

a switch arm that is driven by a cam;

a main arm that drives a valve of the internal combustion engine when swinging;

a switch pin attached to the main arm so as to be displaceable; and a displacing device that displaces the switch pin to a disconnected position to switch the variable valve mechanism to a disconnected state where the switch arm makes a relative reciprocating displacement relative to the main arm in an idle swing direction and in a return direction opposite thereto according to rotation of the cam, and that displaces the switch pinto a connected position to switch the variable valve mechanism to a connected state where the switch arm and the main arm swing together, wherein during switching from the disconnected state to the connected state, if the switch pin is displaced to the connected position while the switch arm is displaced in the idle swing direction relative to the main arm and thus the switch arm comes to an idle swing direction side with respect to the switch pin, the switch arm being displaced in the return direction relative to the main arm comes in sliding contact with a pin end surface of the switch pin, and the switch arm presses the pin end surface toward the disconnected position during a period between a sliding contact start time and a sliding contact end time so as to push back the switch pin, and in the case where a pressed center is defined as a center position of a pressing force received from the switch arm at a sliding contact portion of the pin end surface with the switch arm, and a pin end surface length is defined as a length along the pin end surface from an idle-swing-side edge, which is an edge of the pin end surface on the idle swing direction side, to a return-side edge, which is an edge of the pin end surface on a return direction side, at least during a period from a 10% position time at which a length from the pressed center to the return-side edge along the pin end surface is 10% of the pin end surface length to the sliding contact end time, a position of the pressed center relative to the pin end surface shifts toward the return direction side without stopping as the switch arm is displaced toward the return direction relative to the main arm, so that the sliding contact ends without stopping of the pressed center at the return-side edge.

2. The variable valve mechanism of an internal combustion engine according to claim 1, wherein at the sliding contact start time when the switch pin is fully displaced to a connected position side, the switch arm does not sliding contact with the idle-swing-side edge, but sliding contacts a portion of the pin end surface on the return direction side with respect to the idle-swing-side edge.

3. The variable valve mechanism of an internal combustion engine according to claim 2, wherein a length along the pin end surface from the idle-swing-side edge to the pressed center at the sliding contact start time is 10% to 90% of the pin end surface length.

4. The variable valve mechanism of an internal combustion engine according to claim 1, wherein when the relative reciprocating displacement is a relative swing, an angle by which the switch arm swings relative to the main arm in the return direction from the 10% position time to the sliding contact end time is 0.3 degrees to 8 degrees.

5. The variable valve mechanism of an internal combustion engine according to claim 1, wherein during a period from a return side shift start time at which the length from the pressed center to the return-side edge along the pin end surface is 20% of the pin end surface length or greater to the sliding contact end time, the position of the pressed center relative to the pin end surface shifts toward the return direction side without stopping as the switch arm is displaced in the return direction relative to the main arm.

6. The variable valve mechanism of an internal combustion engine according to claim 5, wherein the return side shift start time is later than the sliding contact start time, and a predetermined portion of the switch arm comes in sliding contact with the pin end surface at the sliding contact start time, and a portion of the switch arm on the idle swing direction side with respect to the predetermined portion comes in sliding contact with the pin end surface at the return side shift start time, so that the position of the pressed center relative to the pin end surface shifts toward the idle swing direction side during a period from the sliding contact start time to the return side shift start time.

7. The variable valve mechanism of an internal combustion engine according to claim 1, wherein the switch arm is pivotally attached in a relatively swingable manner to the main arm, and the relative reciprocating displacement is a relative swing.

8. The variable valve mechanism of an internal combustion engine according to claim 1, wherein the main arm includes two main arm sidewall portions provided on both sides of the switch arm in a width direction and a connecting portion connecting the two main arm sidewall portions to each other, and the switch pin is attached to the connecting portion so as to be displaceable in a longitudinal direction of the main arm.

9. The variable valve mechanism of an internal combustion engine according to claim 1, wherein the displacing device includes:

a spring that urges the switch pin toward the connected position; and a hydraulic device that hydraulically presses the switch pin toward the disconnected position, and the hydraulic device relatively increases hydraulic pressure so as to hydraulically displace the switch pin to the disconnected position and relatively reduces the hydraulic pressure so as to displace the switch pin to the connected position with an urging force of the spring.

10. A variable valve mechanism of an internal combustion engine, comprising:

a switch arm that is driven by a cam;

a main arm that drives a valve of the internal combustion engine when swinging;

a switch pin attached to the main arm so as to be displaceable; and a displacing device that displaces the switch pin to a disconnected position to switch the variable valve mechanism to a disconnected state where the switch arm makes a relative reciprocating displacement relative to the main arm in an idle swing direction and in a return direction opposite thereto according to rotation of the cam, and that displaces the switch pin to a connected position to switch the variable valve mechanism to a connected state where the switch arm and the main arm swing together, wherein during switching from the disconnected state to the connected state, if the switch pin is displaced to the connected position while the switch arm is displaced in the idle swing direction relative to the main arm and thus the switch arm comes to an idle swing direction side with respect to the switch pin, the switch arm being displaced in the return direction relative to the main arm comes in sliding contact with a pin end surface of the switch pin, and the switch arm presses the pin end surface toward the disconnected position during a period between a sliding contact start time and a sliding contact end time so as to push back the switch pin, and at the sliding contact start time when the switch pin is fully displaced to a connected position side, the switch arm does not sliding contact with an idle-swing-side edge, which is an edge of the pin end surface on the idle swing direction side, but sliding contacts a portion of the pin end surface on a return direction side with respect to the idle-swing-side edge.

11. The variable valve mechanism of an internal combustion engine according to claim 10, wherein a length along the pin end surface from the idle-swing-side edge to the pressed center at the sliding contact start time is 10% to 90% of the pin end surface length.

12. The variable valve mechanism of an internal combustion engine according to claim 10, wherein the switch arm is pivotally attached in a relatively swingable manner to the main arm, and the relative reciprocating displacement is a relative swing.

13. The variable valve mechanism of an internal combustion engine according to claim 10, wherein the main arm includes two main arm sidewall portions provided on both sides of the switch arm in a width direction and a connecting portion connecting the two main arm sidewall portions to each other, and the switch pin is attached to the connecting portion so as to be displaceable in a longitudinal direction of the main arm.

14. The variable valve mechanism of an internal combustion engine according to claim 10, wherein the displacing device includes:

a spring that urges the switch pin toward the connected position; and a hydraulic device that hydraulically presses the switch pin toward the disconnected position, and the hydraulic device relatively increases hydraulic pressure so as to hydraulically displace the switch pin to the disconnected position and relatively reduces the hydraulic pressure so as to displace the switch pin to the connected position with an urging force of the spring.

* * * * *